US005115474A

United States Patent [19]

Tsuchiya et al.

[11] Patent Number: 5,115,474

[45] Date of Patent: May 19, 1992

[54] SPEAKER SYSTEM

[75] Inventors: Yukio Tsuchiya; Hiroshi Tanaka; Shunichi Takahashi, all of Saitama, Japan

[73] Assignee: Pioneer Electronic Corporation, Tokyo, Japan

[21] Appl. No.: 698,175

[22] Filed: May 6, 1991

Related U.S. Application Data

[63] Continuation of Ser. No. 282,229, Dec. 9, 1988, abandoned.

[30] Foreign Application Priority Data

Apr. 30, 1988 [JP] Japan ..... 63-59608[U]

[51] Int. Cl.[5] ..... H04R 25/00

[52] U.S. Cl. ..... 381/158; 181/166; 181/172

[58] Field of Search ..... 181/166, 171, 172; 381/158

[56] References Cited

U.S. PATENT DOCUMENTS

| | | | |
|---|---|---|---|
| 3,835,256 | 9/1974 | Wieder | 381/86 |
| 3,837,425 | 9/1974 | Bozak | 181/166 |
| 4,056,697 | 11/1977 | Heil | 381/202 |
| 4,797,935 | 1/1989 | Tanaka | 381/158 |
| 4,847,908 | 7/1989 | Nieuwendijk | 381/202 |
| 4,881,617 | 11/1989 | Faraone | 181/172 |

FOREIGN PATENT DOCUMENTS

| | | | |
|---|---|---|---|
| 62-8698 | 6/1987 | Japan . | |
| 2056817 | 3/1981 | United Kingdom | 181/172 |

*Primary Examiner*—Forester W. Isen

*Attorney, Agent, or Firm*—Sughrue, Mion, Zinn, Macpeak & Seas

[57] ABSTRACT

In a speaker system with a speaker unit attached to a baffle board, the frame of the speaker unit vibrates so that the quality of sound transmitted from the speaker is impaired. These vibrations can be attenuated by coating the outer circumferential edge of the frame with an elastic material such as rubber.

2 Claims, 2 Drawing Sheets

FREQUENCY RESPONSE CHARACTERISTIC

SPEAKER SYSTEM

This is a continuation of application No. 07/282,229 filed Dec. 9, 1988 now abandoned.

BACKGROUND OF THE INVENTION

1. Field of the Invention

The present invention relates to a speaker system having a speaker midship mount attaching structure in which a speaker unit is attached to an inner baffle board in a cabinet.

2. Description of the Prior Art

Recently, compact discs have been produced so that the performance of sources have been sharply improved. Therefore, in speaker systems for reproducing such sources, it has become necessary to improve the quality of material of diaphragms and to improve reproducing capability. To this end, a speaker system employs a speaker unit midship mount attaching structure to reduce unnecessary vibrations of a baffle board. However, a frame of a woofer additionally takes part in the unnecessary vibrations on the front of a cabinet. Except in special cases, the frame of the woofer is generally made of an aluminum alloy so that it is strong enough to hold a magnetic circuit. When a signal is applied to the speaker unit so that a driving force is applied to the diaphragm from a voice coil, the vibrations are naturally transmitted to the frame. The vibrations of the frame are also radiated into space as sound, so that an audience listens to the vibrational sound mixed with the sound transmitted from the diaphragm.

In such a system, there has been a problem with the quality of sound produced by the speaker system because of the frame vibrations. That is, the frame is ring-like on the front of the cabinet and the exposed surface area of the frame is considerably large and sometimes larger than the area of the diaphragm of a speaker, so that the vibrational sound level from the frame cannot be neglected. FIG. 3(*b*) shows a result of investigation of an acceleration characteristic of a woofer frame at a portion thereof on the front of the cabinet, that is, at the outermost circumferential edge surface of the woofer frame, with respect to a conventional device of the midship mount type. In this case, although a crossover frequency is 2.5 KHz, vibrations of considerably higher frequencies are radiated from the surface of the woofer. Additionally, it is believed that vibrations from a tweeter are also transmitted to the surface of the frame of the woofer.

SUMMARY OF THE INVENTION

It is therefore an object of the present invention to solve the above problem in the prior art.

It is another object of the present invention to provide a speaker system in which vibrations radiated form a frame of a speaker unit are reduced to improve the fidelity of reproduced sound.

In order to attain the above objects, the speaker system according to the present invention comprises a speaker unit attached to an inner baffle board provided within a cabinet, in which the outermost circumferential edge of a frame of the speaker unit on the front of the cabinet is coated with an elastic material such as rubber.

DETAILED DESCRIPTION OF THE PREFERRED EMBODIMENT

Figure 1:
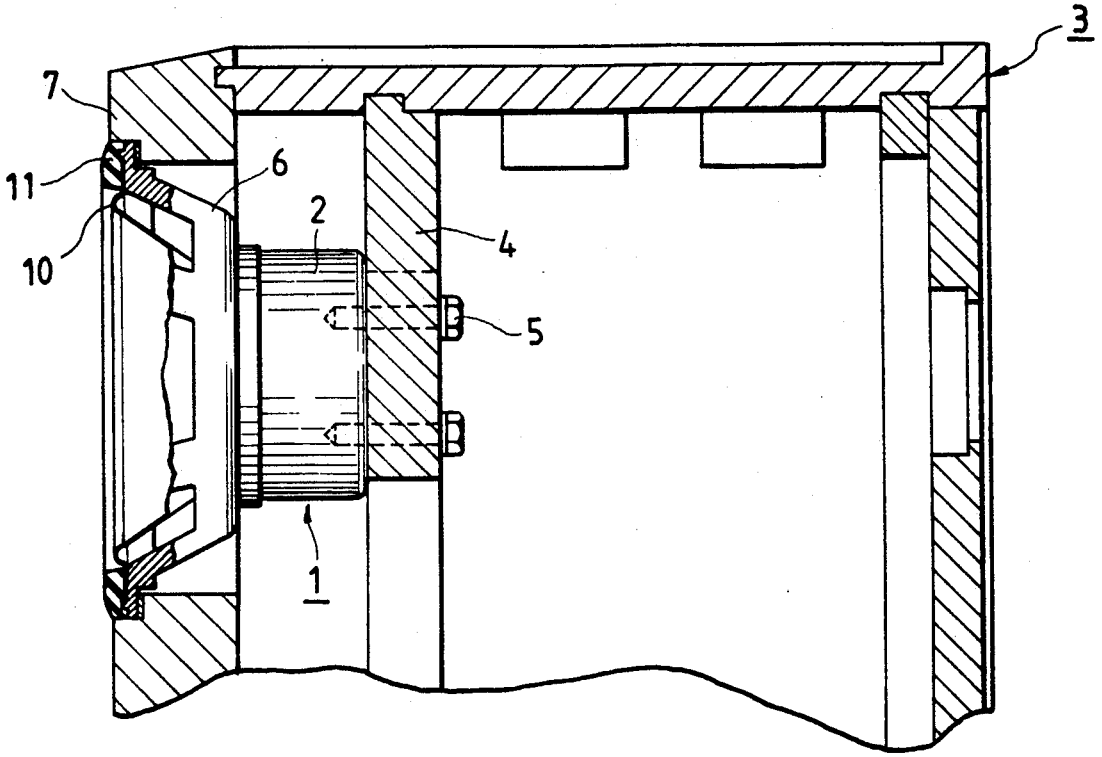
FIG. 1 is a vertically sectional side view showing an embodiment of the present invention.
Figure 2:
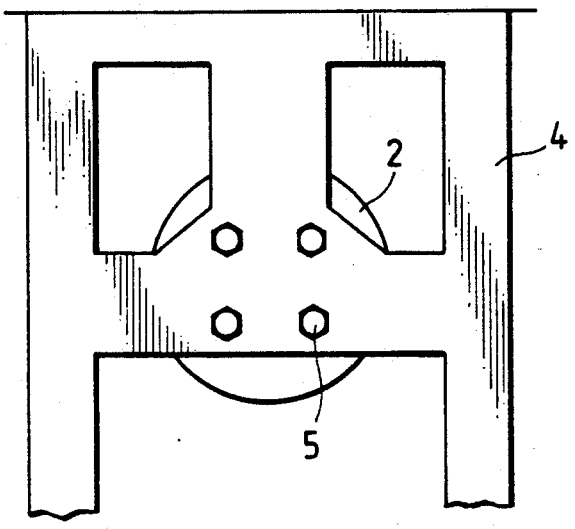
FIG. 2 is a view of the back of an inner baffle board.

Referring to the drawings, an embodiment of the present invention will be specifically described hereunder. As shown in the drawings, a speaker unit 1 is fixed at its yoke portion 2, with bolts 5, to an inner baffle board 4 vertically provided within a cabinet 3 so that the speaker unit 1 is held at a required position in the cabinet 3. A frame 6 of the speaker unit 1 is made of an aluminum alloy and is located at the front of the cabinet 3 so that the outermost circumferential edge 6*a* of the frame 6 is in contact with a step portion 7*a* formed on a front baffle board 7 of the cabinet 3 through a gasket 8. A diaphragm 9 of the speaker unit 1 is supported at its outermost circumferential edge by an edge member 10 which is in turn supported by the front portion of the outermost circumferential edge 6*a* of the frame 6. A flange 6*b* is formed on the front of the outermost circumferential edge 6*a*. The outermost circumferential edge 6*a* is coated with an elastic material 11 such as rubber or the like. A portion 10*a* of the edge member 10 supported by the frame 6 is sandwiched between the outermost circumferential edge 6*a* and the elastic material 11 and the flange 6*b* is fitted in a groove 11*a* formed in the elastic material 11, so that the edge member 10 is held in a fixed position.

In such an arrangement, the front of the outermost circumferential edge 6*a* of the frame 6 located and exposed at the front of the cabinet 3 is coated with the elastic material 11. Thus, vibrations transmitted to the frame 6 from the yoke side which are radiated into space from the front of the cabinet 3, as described above, can be attenuated by the elastic material 11. The elastic material 11 can attenuate such vibrations, suppress the resonance of the frame 6, and, additionally, improve decorativeness in a design and external appearance of the front of the cabinet 3.

Figure 3:
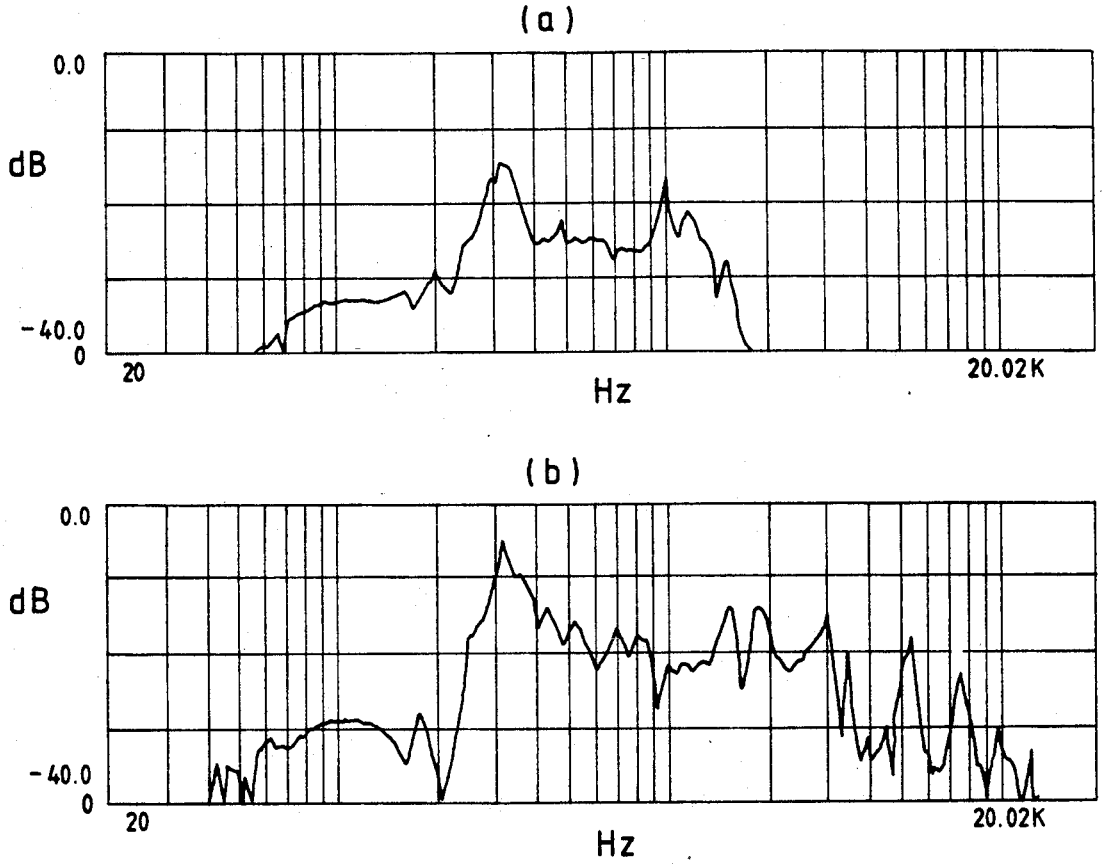
FIGS. 3(*a*) and (*b*) are diagrams showing acceleration characteristics on the frame surfaces of the speaker system according to the present invention and of a conventional speaker system respectively.
Figure 4:
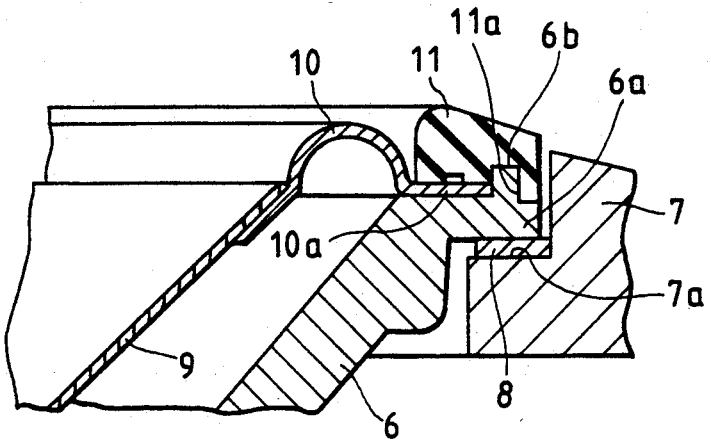
FIG. 4 is an enlarged cross-section of the main portion of an embodiment of the present invention.

Thus, due to the coating of the outermost circumferential edge 6*a* of the frame 6 with the elastic material 11, the result of measurement of the acceleration characteristic is as shown in FIG. 3(*a*). This shows how the vibrations radiated into space were sharply attenuated in comparison with the vibrations in a conventional frame (FIG. 3(*b*)). It is further shown that, in particular, high-frequency components of the vibrations were sharply attenuated by the system in which the elastic material 11 was used.

As described above, according to the present invention, since the outermost circumferential edge of a frame of a speaker unit is coated with an elastic material such as rubber or the like, vibrations radiated from the front of a cabinet into space through the frame can be attenuated to thereby improve the fidelity of reproduced sound in a sound field.

What is claimed is:

1. A speaker system comprising:

a cabinet having a baffle board therein;

a speaker comprising a frame, an edge member, and a diaphragm, said diaphragm of said speaker unit being supported at its outermost circumferential edge by said edge member, said edge member being supported by a front portion of an outermost circumferential edge of said frame, said outermost circumferential edge of said frame being disposed at the front of said cabinet; and damping material disposed on and covering said front portion of said outermost circumferential edge of said frame to minimize sound radiation from said outermost circumferential edge of said frame.

2. A speaker system as in claim 1, wherein the damping material is elastic.

* * * * *